US005394315A

United States Patent [19]

Ahroni

[11] Patent Number: 5,394,315

[45] Date of Patent: Feb. 28, 1995

[54] PLUG-IN TYPE LAMP ASSEMBLY WITH LOCKED-ON LAMP BASE AND REFLECTOR

[76] Inventor: Joseph M. Ahroni, 2701 W. Manor Pl., #204, Seattle, Wash. 98199

[21] Appl. No.: 891,825

[22] Filed: Jun. 1, 1992

Related U.S. Application Data

[63] Continuation-in-part of Ser. No. 725,586, Jul. 3, 1991, Pat. No. 5,154,508, which is a continuation-in-part of Ser. No. 637,477, Jan. 4, 1991, Pat. No. 5,121,310.

[51] Int. Cl.[6] ..... H01R 33/00

[52] U.S. Cl. ..... 362/226; 362/241; 362/277

[58] Field of Search ..... 362/226, 238, 241, 249, 362/277, 319

[56] References Cited

U.S. PATENT DOCUMENTS

| | | | |
|---|---|---|---|
| 1,273,637 | 7/1918 | Luth | 362/226 |
| 2,075,364 | 3/1937 | Smith | 362/226 |
| 4,714,984 | 12/1987 | Spector | 362/226 X |

*Primary Examiner*—Stephen F. Husar
*Attorney, Agent, or Firm*—Seed and Berry

[57] ABSTRACT

A light and reflector assembly has a lamp holder with a plug-in lamp base mounted therein which has a bulb surrounded by a reflector sleeved on the lamp holder. Releasable locking means are provided for locking the lamp base to the lamp holder responsive to pushing the lamp base into the lamp holder, and for then locking the reflector to the lamp holder responsive to twisting of the reflector after being sleeved onto the lamp holder. The reflector locking means may interact with the lamp base locking means.

11 Claims, 4 Drawing Sheets

FIG. 3
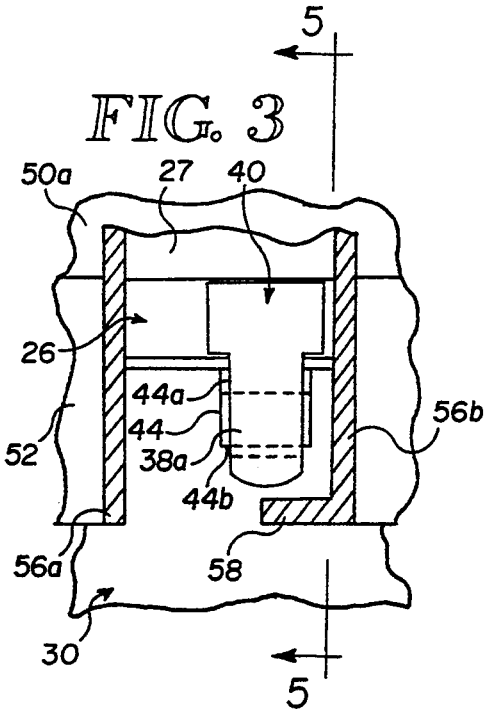
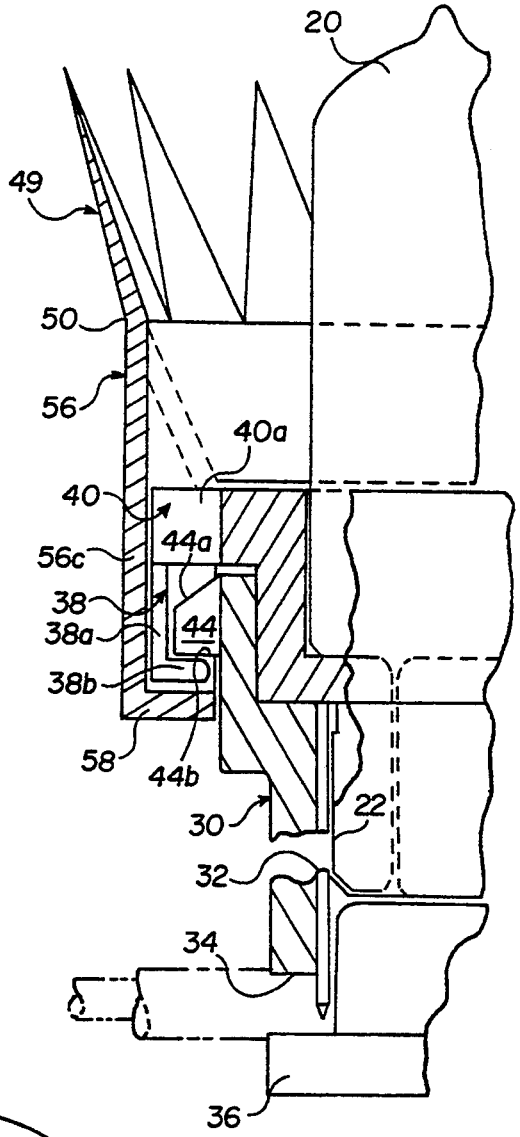
FIG. 5
FIG. 4
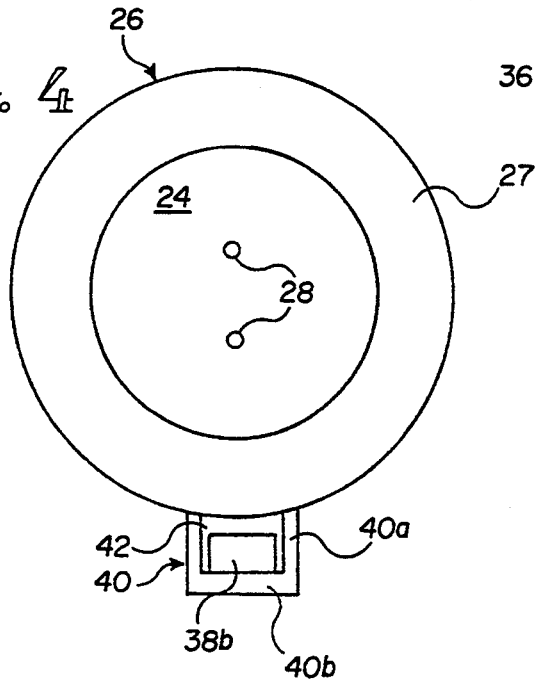

FIG. 6
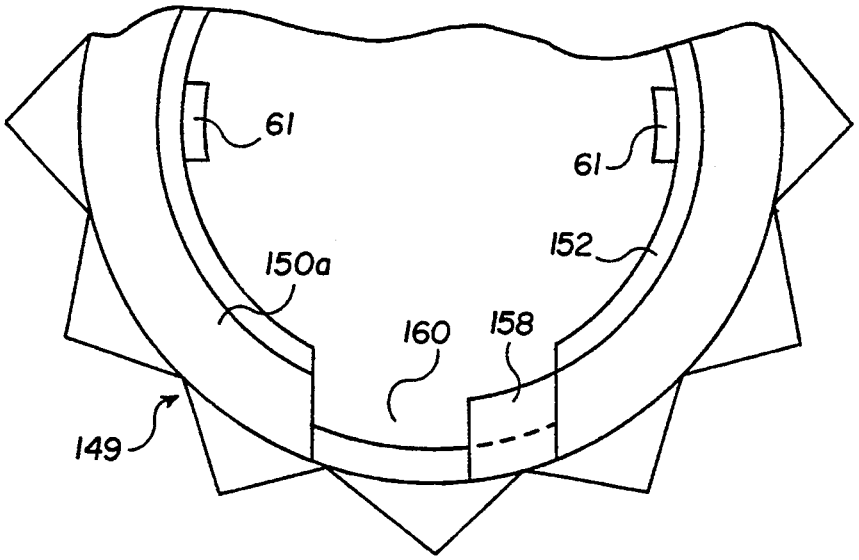
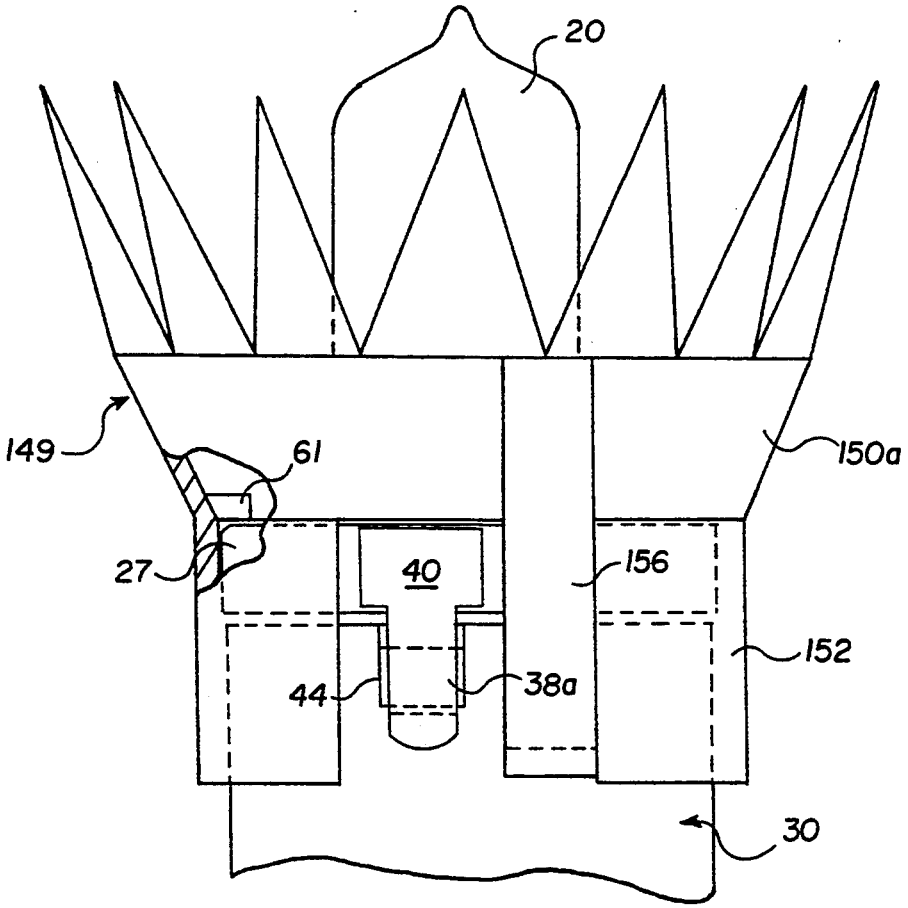
FIG. 7

PLUG-IN TYPE LAMP ASSEMBLY WITH LOCKED-ON LAMP BASE AND REFLECTOR

REFERENCE TO RELATED APPLICATIONS

This application is a continuation-in-part of my application Ser. No. 07/725,586, filed Jul. 3, 1991, now U.S. Pat. No. 5,154,508, which is a continuation-in-part of my application Ser. No. 07/637,477, filed Jan. 4, 1991, now U.S. Pat. No. 5,121,310.

TECHNICAL FIELD

The present invention relates to lamp units of the type having a push-in bulb unit and a detachable reflector as commonly used in decorative light sets.

BACKGROUND OF THE INVENTION

In a typical push-in type lamp unit used in decorative light sets a bulb is mounted in a plastic lamp base and has a pair of lead wires which extend through the bottom of the lamp base and double back over opposite outer side faces of a plug-in portion of the lamp base. The lamp base plugs into a socket in a lamp holder presenting contact elements at opposite sides which are engaged by the lead wires from the bulb. The contact elements in turn engage insulated wires which may be presented by a single cord as shown, for example, in Pat. No. 4,779,177. Preferably the plug-in portion of the lamp base and the socket in the lamp holder are shaped so that the lamp base must be properly oriented for proper lead wire to contact element engagement in order for the plug-in portion to be pushed into the socket. Commonly decorative reflectors surround the bulb and have tubular extensions which are sleeved with a friction fit on the lamp holder.

Sometimes the plug-in portion of the lamp base in a plug-in light assembly works loose from the lamp holder socket sufficiently to break electrical contact between the bulb leads and the contact elements in the lamp holder, and sometimes the associated reflector unit comes loose from the lamp holder. Such can occur, for example, during packing and shipping, or while the light set is being handled while being mounted in a decorating position or removed therefrom for storage.

Although a relatively snug fit between the lamp base and the lamp holder is preferred to maintain electrical contact between the bulb leads and the contact elements, it is also preferred to have the lamp bases relatively easy to remove for bulb replacement in case of bulb failure. Accordingly, there has been a need for a practical, effective lock-on system to prevent unintentional dislodgement of the lamp bases and reflectors from the lamp holders of plug-in type decorative light units, but which can both be easily manually released for bulb replacement. Since the lamp bases, lamp holders, and reflectors are normally plastic injection-molded parts, a solution to the lamp loosening and reflector loosening problem is not practical if it unduly complicates the molding process or assembly of the sets.

SUMMARY OF THE INVENTION

The present invention meets the lock-on need by providing cooperating locking elements on the lamp base, reflector and lamp holder components of a plug-in type decorative light set which are injection molded as integral parts of these components. In the preferred embodiment for locking the lamp base to the lamp holder, a hook-like locking element depends from a U-shaped mounting piece on the lamp base and snaps over a protrusion on the lamp holder providing a complementing retaining shoulder which fuses to a locking bill on the hook-like locking element when the lamp base is pushed into the lamp holder. The U-shape of the mounting piece permits a male element in the injection molding die for forming the bill of the hook-like element to occupy a position passing through the mounting pieces.

The preferred embodiment of the reflector unit has a mounting sleeve extension having most of its circumference of a diameter sufficient to clear the upper end portion of the lamp holder, but not sufficient to clear the locking hook element on the lamp base and the complementing protrusion on the lamp holder. The remainder of the circumference of the sleeve extension is dished outwardly sufficiently as a bulge to pass over the locking hook and protrusion. This bulge has an in-turned locking lip at its lower end for part of its width which adjoins a bottom access opening into the interior of the bulge. This access opening is made wider than the locking hook and protrusion so that the reflector can be sleeved on the lamp holder when the access opening is aligned with the locking hook. Then the reflector unit can be twisted sufficiently to position the locking lip directly beneath the bill of the locking hook, thereby locking the reflector unit in position. The bulge is radially sized to prevent outward springing of the locking hook sufficient to clear the locking shoulder of the protrusion on the lamp holder. This adds locking security for the lamp base.

BRIEF DESCRIPTION OF THE DRAWINGS

FIG. 3 is a fragmentary elevational view taken like FIG. 2, but showing the reflector unit in locked position;

FIG. 4 is a top plan view of the lamp base unit before insertion of the bulb;

FIG. 5 is a fragmentary vertical sectional view taken as indicated by line 5—5 in FIG. 3;

FIG. 6 is a fragmentary bottom plan view of a modified reflector unit;

FIG. 7 is a fragmentary elevational view showing the modified reflector unit positioned in correspondence to FIG. 2.

DETAILED DESCRIPTION OF THE INVENTION

Figure 1:
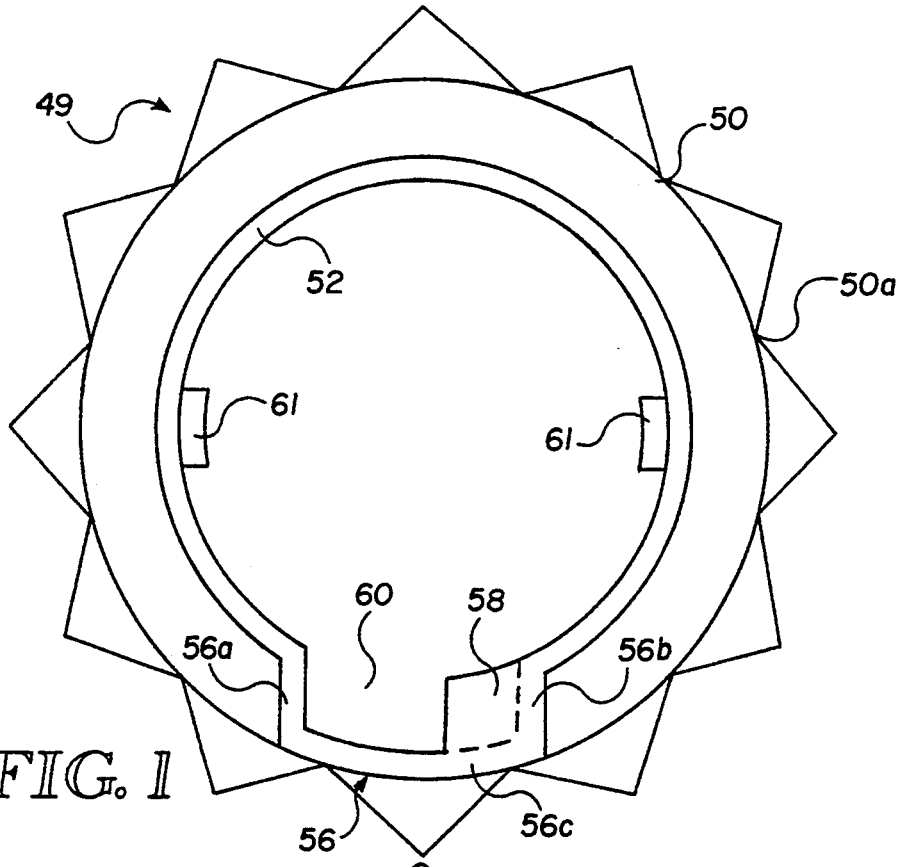
FIG. 1 is a bottom plan view of a reflector unit made in accordance with the present invention.
Figure 2:
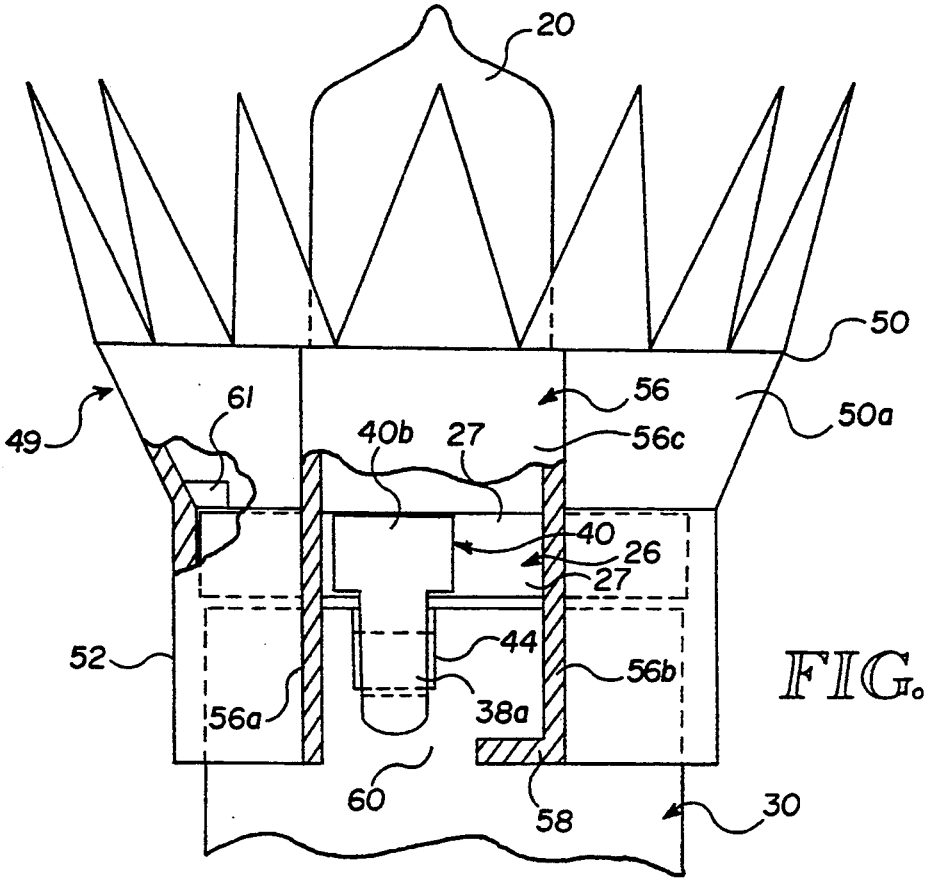
FIG. 2 is a fragmentary elevational view showing the reflector unit, partially broken away, after being mounted on a lamp assembly, but before being moved into locked position.

For purposes of example, the invention is applied to a lamp assembly 18 of the general type shown in U.S. Pat. No. 4,779,171. The lamp assembly 18 has a bulb 20 with a pair of lead wires 22. The bulb 20 fits into a socket 24 provided by a lamp base 26 which has an enlarged upper rim portion 27 and a pair of bottom openings 28 in the base of the socket 24 through which the lead wires 22, are fed. The leads extend from the openings 28, and double-back over opposite side faces 29 of the lamp base 26.

The lamp base 26 is complemented by a lamp holder housing 30 providing a socket 31 to receive the base portion of the lamp base 26. A pair of contact elements 32 are mounted in selected positions at opposite sides of the socket 31 to be engaged by respective of the leads 22. The contact elements 32 project by insulating-piercing ends into a wireway 34 formed by the holder 30 and a base unit 36 which preferably snap fits with the housing 30 in a manner such as shown in U.S. Pat. No. 4,807,908 or U.S. Pat. No. 5,109,324.

The rim portion 27 of the lamp base 26 is provided with a hook-like active locking element 38 having a stem 38*a* carrying a turned-in locking bill 38*b*. The stem 38*a* is connected to the rim 27 by a U-shaped mounting piece 40 having a pair of support arms 40*a* and an intermediate mounting piece 40*b*. The gap 42 between the support arms 40*a* is aligned with the locking bill 38*b* so as to provide a withdrawal path for a male element in the injection molding die which forms the upper face of the locking bill 38*b*. The stem 38*a* has sufficient resiliency to act as a spring finger so that the locking bill 38*b* can spring outwardly sufficiently to ride over a ramp 44*a* provided at on a protuberance 44 at the top of the lamp holder 30 and snap back beneath a keeper shoulder 44*b* at the bottom of the protuberance 44 when the lamp base 26 is pushed into the socket 31 provided by the lamp holder 30 during assembly of the light set.

The locking bill 34*b* of the locking element 38 can be manually sprung outwardly out of locking position beneath the shoulder 42*b* when it is desired to remove the lamp base unit 26 for bulb replacement. It is not essential that the locking bill 50*b* fit snugly beneath the shoulder 42*b*. A gap can initially exist between the locking bill 38*b* and shoulder 42*b* since the purpose of the locking feature is to restrict the amount of withdrawal of the lamp base 26 from the lamp holder 30 to an amount still maintaining completion of the circuit to the bulb 20 via the contact elements 32.

A reflector unit 49 is provided having a reflector 50 surrounding the bulb and having an integral mounting extension 52 sleeved on an upper portion of the lamp holder 30. The reflector unit is preferably injection molded from a suitable polymer such as a transparent polystyrene, and the reflector portion 50 may be selected from a great variety of ornamental designs well known in the art. For purposes of example the reflector is shown as having an intermediate flared portion 50*a* from which a plurality of tapered petals 50*b* project.

The mounting extension 52 preferably locks into position by use of a locking element 54 cooperating with the bill 38*b* on the snap hook 38. In the preferred embodiment the extension is generally tubular, but has an outwardly bulging section 56 defined by opposed side walls 56*a*, 56*b* and an arched outer wall 56*c*. The bottom of the bulge 56 has a locking lip 58 supported by the walls 56*b*, 56*c* and an opening 60 which is large enough to clear the hook 38 and protrusion 44 when the reflector unit is moved endwise over the bulb 20 and the upper portion of the lamp holder 30 with the opening 60 aligned with the snap hook. The extension 52 has a length such that the lip 58 is at a level beneath that of the bill 38*b* of the locking element 38. Hence, a slight clock-wise twisting of the reflector unit relative to the lamp holder 30 will position the lip 58 directly beneath the locking bill 38*b* so that endwise loosening movement of the reflector unit will be prevented by engagement of the lip 58 with the bill 38*b*.

The outer wall 56*c* of the bulge 56 is preferably of a diameter which only gives clearance between the wall 56*c* and the back of the locking hook 38 adequate to permit the reflector extension 52 to be applied. This arrangement prevents the stem 38*a* of the locking hook from springing outwardly sufficiently for the bill 38*b* to clear the keeper shoulder 44*b* when the reflector unit is in locked position. Thus, the reflector extension 58 prevents the locking hook 38 from being released at the same time the bill 38*b* of the locking hook restricts upward movement of the locking lip 58 to prevent unintentional removal of the reflector 50.

Although it is preferred to have the reflector extension 52 completely surround the lamp holder 30 for most of the length of the extension, it will be appreciated that this in not required for locking the reflector unit in position. All that is required is that there be a locking lip at the lower end of a reflector extension element which will clear the locking elements 38, 44 when the extension is being fitted to the lamp holder 30 and twisted relative to the lamp holder to position the locking lip directly beneath the locking bill 38*b*.

Figure 8:
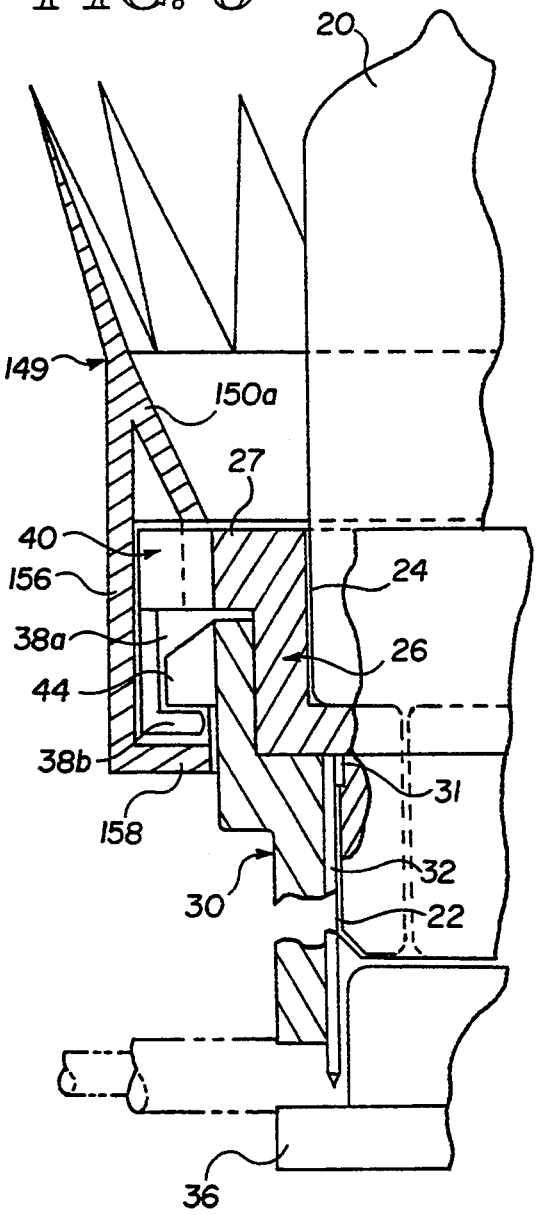
FIG. 8 is a fragmentary sectional unit in locking position and take in the same manner as FIG. 5.

Referring to FIG. 6–8, a modified reflector unit 149 is shown which is like the reflector unit 49 but has most of the bulge 56 on its sleeve extension 152 eliminated and replaced by a cutout 160 corresponding in width to the opening 60 at the bottom of the bulge 56 in the reflector unit 49. A locking lip 158 is provided corresponding to the lip 58 on the reflector unit 49, and this lip 158 projects inwardly as a foot from the bottom of a leg 156 which depends from the upper part of the flared intermediate portion 150*a*. The leg 156 may be stiffened by providing a side wall like the side wall 56*b* on the reflector unit 49.

The modified reflector unit 149 may be applied in the same manner as the reflector unit 49, and namely, by sleeving it onto the lamp holder 30 with the cutout 160 aligned with the locking hook 38 as shown in FIG. 7. Then the reflector unit 149 is turned clockwise relative to the lamp holder until the locking lip 158 is positioned beneath the locking bill 38*b* as shown in FIG. 8.

The leg 156 may be made flexible enough radially of the reflector to permit the locking bill 38*b* to be moved into locking position by riding over the locking hook element 38 responsive to pushing the sleeve 152 of the reflector unit 149 onto the lamp holder 30. In this case the top of the U-shaped mounting piece 40 for the locking hook 38 would preferably be sloped in the manner of the ramp 44*a* on the protrusion 44.

It is important to note that in both illustrated embodiments of the invention the reflector unit can be easily injection molded in one piece because a male die element can form the upper face of the locking lips 58, 158 and retract through the open upper end of the reflector.

Although it is preferred to have the lamp base 26 and the reflector unit 49 both provided with locking elements so that use of the reflector units 49 can be optional, it will be appreciated that the locking lip 58 will engage the shoulder 44*b* on the bottom of the protrusion 44 and prevent unintentional removal of the reflector unit if the locking bill 38*b* is not present. Also, it will be appreciated that, although not preferred, a second protrusion 44 can be provided on the lamp holder 30 for lock engagement registering with the locking lip 58 or 158. In that case a second bulge 56 open at its lower end, or a second cutout 160, would be provided.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A light and reflector assembly comprising:

a plastic lamp holder unit presenting a socket;

a plastic plug-in lamp base unit in said socket and having a bulb mounted therein;

a first locking element integral with a first of said units;

a complementing second locking element integral with the second of said units;

said first locking element being in locking relationship with the second locking element to lock said units together, and being adapted to be moved out of said unit locking relationship when it is desired to remove said lamp base unit from said socket to replace said bulb;

a reflector unit around said bulb and detachably interfitting with said socket unit; and a third locking element integral with said reflector unit and in reflector locking relationship with said first locking element to lock said reflector unit on said lamp socket unit, said third locking element being adapted to be moved out of said reflector locking relationship when it is desired to remove said reflector and lamp base unit to replace said bulb.

2. An assembly according to claim 1 in which said reflector unit is arranged to prevent said first locking element from moving out of said locking relationship.

3. A light and reflector assembly according to claim 1 in which said first locking element is on said lamp base unit, and said second locking element is stationary and is mounted on said socket unit, and in which said third locking element overlaps said first locking element when in said reflector locking relationship.

4. A light and reflector assembly according to claim 1 in which said third locking element overlaps said first locking element to prevent said first locking element from moving out of said locking relationship.

5. A light and reflector assembly according to claim 1 in which said third locking element moves into reflector locking position responsive to limited twisting movement of the reflector unit on the lamp socket unit.

6. A light and reflector assembly comprising:

a lamp holder presenting a socket and having an exterior stationary keeper;

a plug-in type lamp unit extending into said socket;

an exterior locking unit on said lamp unit movable relative thereto into locking engagement with said keeper and adapted to be unlocked by unlocking movement;

a removable reflector surrounding said lamp unit and detachably mounted on said lamp holder in overlapping relation to said locking unit.

7. An assembly according to claim 6 in which said reflector has locking means for detachably locking the reflector to the lamp holder responsive to twisting movement of the reflector relative to the lamp holder.

8. An assembly according to claim 7 in which said exterior locking unit comprises a moveable arm with an integral locking element thereon adapted to interfit with said keeper responsive to movement of said arm relative to said lamp unit when the lamp unit is seated in said socket, said reflector unit overlapping said arm to prevent said arm from being moved away from said keeper.

9. A combination plug-in type lamp assembly and reflector comprising:

a holder presenting a socket having contacts exposed therein;

a plug-in bulb unit extending lengthwise into said socket and having leads engaging said contacts, said bulb unit being removable from said socket by movement of the bulb unit in an endwise direction relative to said holder;

bulb-unit locking means on said bulb unit for locking the bulb unit in said socket position responsive to plugging of said bulb unit into said socket;

a reflector fitting onto part of said holder in surrounding relation to said bulb unit;

and combination keeper and locking means on said reflector for keeping said bulb-unit locking means in bulb-unit locking position and also locking said reflector onto said holder, responsive to lengthwise movement of the reflector relative to said holder and bulb unit followed by limited twisting movement of the reflector relative to the holder and bulb unit.

10. A combination according to claim 9 in which said bulb-in locking means comprises a protrusion on said holder and a cooperating snap hook on said bulb unit, said protrusion having a shoulder and said locking bill being positioned opposite said shoulder when in locking position.

11. A combination according to claim 10 in which said combination keeper and locking means has a locking element arranged to clear said snap hook and protrusion when said reflector is moved lengthwise relative to said holder and to assume a locked position opposite said locking bill during said limited twisting movement.

* * * * *